US005524957A

United States Patent [19]

Gibriano

[11] Patent Number: 5,524,957

[45] Date of Patent: Jun. 11, 1996

[54] CHAIR ACCESSORY

[76] Inventor: James Gibriano, 640 Warfield Rd., N. Plainfield, N.J. 07060

[21] Appl. No.: 251,098

[22] Filed: May 31, 1994

[51] Int. Cl.[6] ..... A47C 7/62

[52] U.S. Cl. ..... 297/144; 297/188.11; 297/188.12; 108/26

[58] Field of Search ..... 297/144, 188.08, 297/188.11, 188.12, 188.13, 188.21, 423.2; 108/26, 44, 45, 46, 152; 312/235.1, 235.5; 5/308

[56] References Cited

U.S. PATENT DOCUMENTS

| | | | |
|---|---|---|---|
| 1,289,897 | 12/1918 | Phillips | 5/308 |
| 1,291,794 | 1/1919 | Droste | 5/308 |
| 1,542,920 | 6/1925 | Swenson | 5/308 |
| 1,930,882 | 10/1933 | McRae | 5/308 |
| 2,854,676 | 10/1958 | Fried et al. | 5/308 |
| 3,027,190 | 3/1962 | Schaefer et al. | 297/188.12 X |
| 4,071,219 | 1/1978 | Seager | 297/192 X |
| 4,241,668 | 12/1980 | Carroll | 108/26 |
| 4,766,838 | 8/1988 | Johnson | 297/252 |
| 4,971,390 | 11/1990 | McGinley | 297/192 |

*Primary Examiner*—Peter R. Brown
*Attorney, Agent, or Firm*—Gottlieb, Rackman & Reisman

[57] ABSTRACT

An accessory can mount onto the seat of a chair. The accessory has a tray slidably mounted on an assembly. The tray can either retract underneath or extend beyond the seat of the chair. The assembly has a pair of opposing grippers. These grippers can hold the assembly underneath the seat of the chair. These grippers have an expandable separation to accommodate size variations in the seat of the chair.

18 Claims, 5 Drawing Sheets

CHAIR ACCESSORY

BACKGROUND OF THE INVENTION

1. Field of the Invention

The present invention relates to chair accessories and in particular to an assembly for attaching a tray to a chair such as a lawn chair.

2. Description of Related Art

At a buffet party people may sit in a chair and eat and drink without a table. Consequently, eating and drinking becomes difficult without a free hand. This problem is especially acute at a lawn party where guests may be seated on a lawn chair. Therefore an accessory tray that can be attached to a chair is greatly needed.

Adaptability is an important design consideration for a tray accessory for a chair. Chairs, especially lawn chairs, can come in various sizes and may have a variety of interfering structure. An adaptable design can work around these variations.

U.S. Pat. No. 4,715,652 shows a stadium chair that clips onto a bench. This known seat has a pair of parallel runners with grooves that hold a sliding tray. This design is not adapted, however, to be mounted on 30 various types of chairs such as lawn chairs.

U.S. Pat. No. 4,556,250 shows a case that is secured to a seat by means of a sleeve. While the case 1 has a sliding tray, the sleeve is not useful for attaching the tray to a variety of chairs. For example, a lawn chair may have struts that connect from the side of the chair to an arm. That structure may prevent the sleeve from slipping around the chair. Moreover, this sleeve interferes with the seating surface and may require an additional cushion.

U.S. Pat. No. 2,755,845 shows a bracket for attaching a tray to a chair, but this structure requires a special type of chair seat which is not ordinarily present in familiar chairs as lawn chairs.

U.S. Pat. Nos. 2,244,459; 5,035,464 and 5,129,702 show various assemblies for attaching a tray to a chair. These assemblies, however, are either not adaptable and may be dedicated to a specific chair. See also U.S. Pat. Nos. 4,341, 418 and 5,096,249.

SUMMARY OF THE INVENTION

In accordance with the illustrative embodiments demonstrating features and advantages of the present invention, there is provided an accessory for a seat of a chair. The accessory has an assembly with a pair of opposing grippers. The assembly is arranged for attachment underneath the seat of the chair. The grippers have an expandable separation to accommodate size variations in the seat of the chair. A tray is slidably mounted at the assembly for retracting underneath and extending beyond the seat of the chair.

By employing such structure, an improved chair accessory is achieved. In a preferred embodiment, two frames are slidably interconnected for adjusting the width of the assembly. By adjusting the width of the assembly, hooks mounted atop the assembly can be attached to various sizes of chairs. In the preferred embodiment, an elastic band or spring is attached between the two frames to urge them together to clamp the hooks onto the edges of the chair seat.

In this preferred embodiment, the two frames each have a support panel supporting a pair of channels having C-shaped cross-sections. The channels of the two frames slide together for adjusting the width of the 15 assembly. A tray is slidably mounted between the channels. In one constructed embodiment, the tray slides through a slot in one of the support panels and enters the groove of a smaller channel. With this nesting arrangement the tray fits a smaller channel and the smaller channel fits inside the larger channel.

Hooks are mounted on the two support panels. The top edge of the support panels are then canted so that the tray will remain horizontal even though the support panels are hooked onto the edge of a slanted chair seat. After the assembly is attached to the chair seat, the tray can be either extended or retracted, depending on whether the user needs the tray to hold food or drink.

BRIEF DESCRIPTION OF THE DRAWINGS

The above brief description, as well as other objects, features and advantages of the present invention will be more fully appreciated by reference to the following detailed description of presently preferred, but nonetheless illustrative embodiments in accordance with the present invention, when taken in conjunction with the accompanying drawings, wherein.

DETAILED DESCRIPTION OF THE PREFERRED EMBODIMENTS

Figure 1:
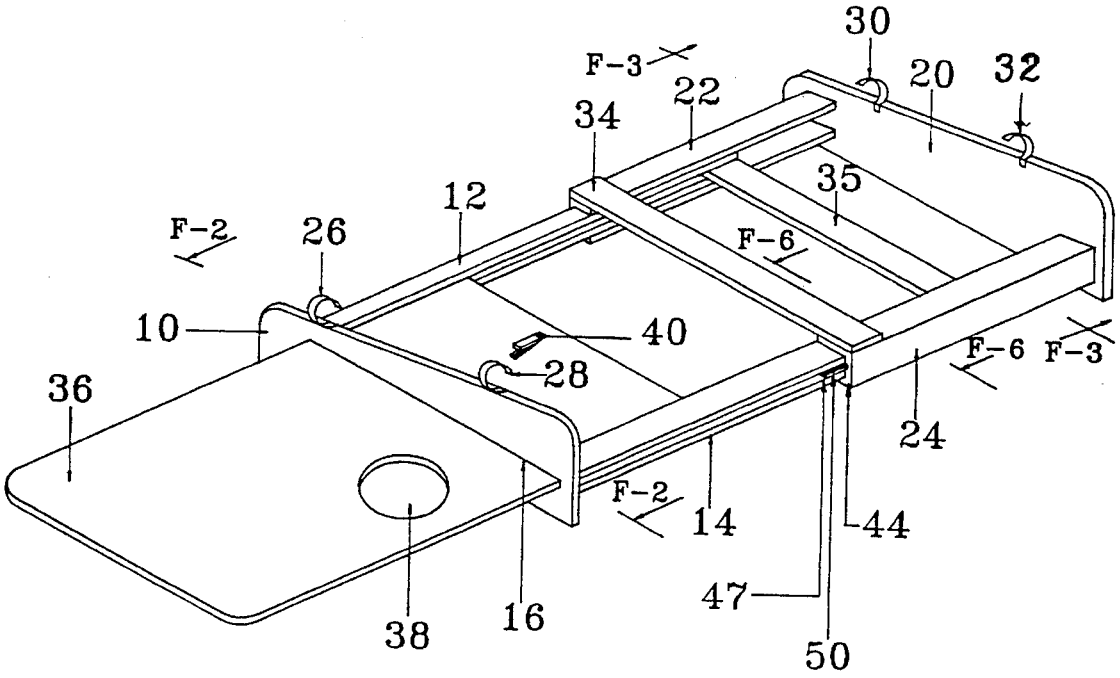
FIG. 1 is an axonometric view of a chair accessory in accordance with the principles of the present invention.
Figure 2:
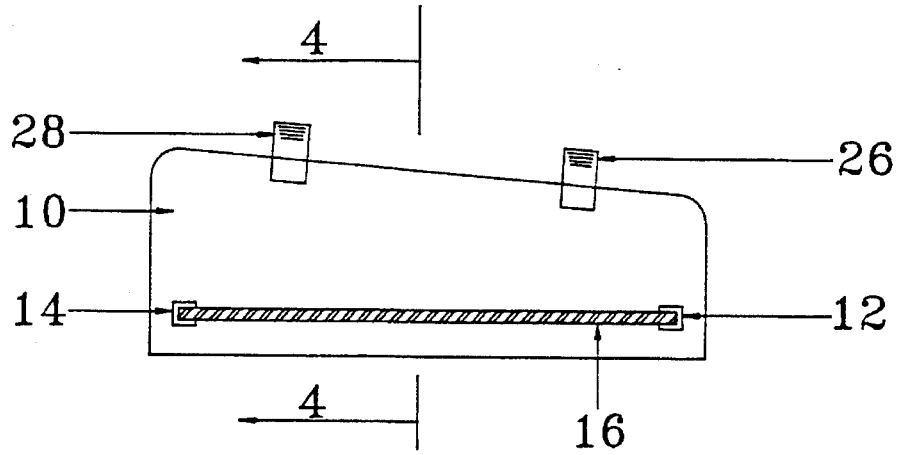
FIG. 2 is a view of a support for the accessory, taken along line 2—2 of FIG. 1.
Figure 3:
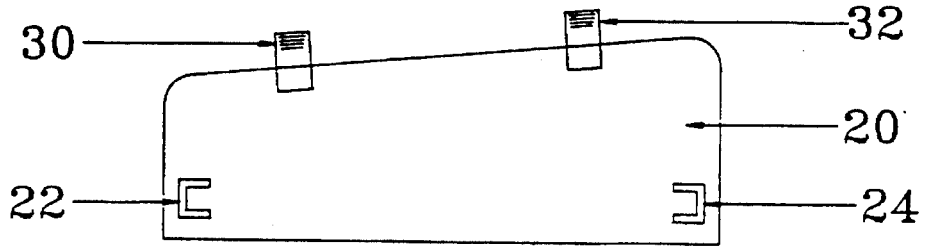
FIG. 3 is an elevational view of another support for the accessory, taken along line 3—3 of FIG. 1.
Figure 4:
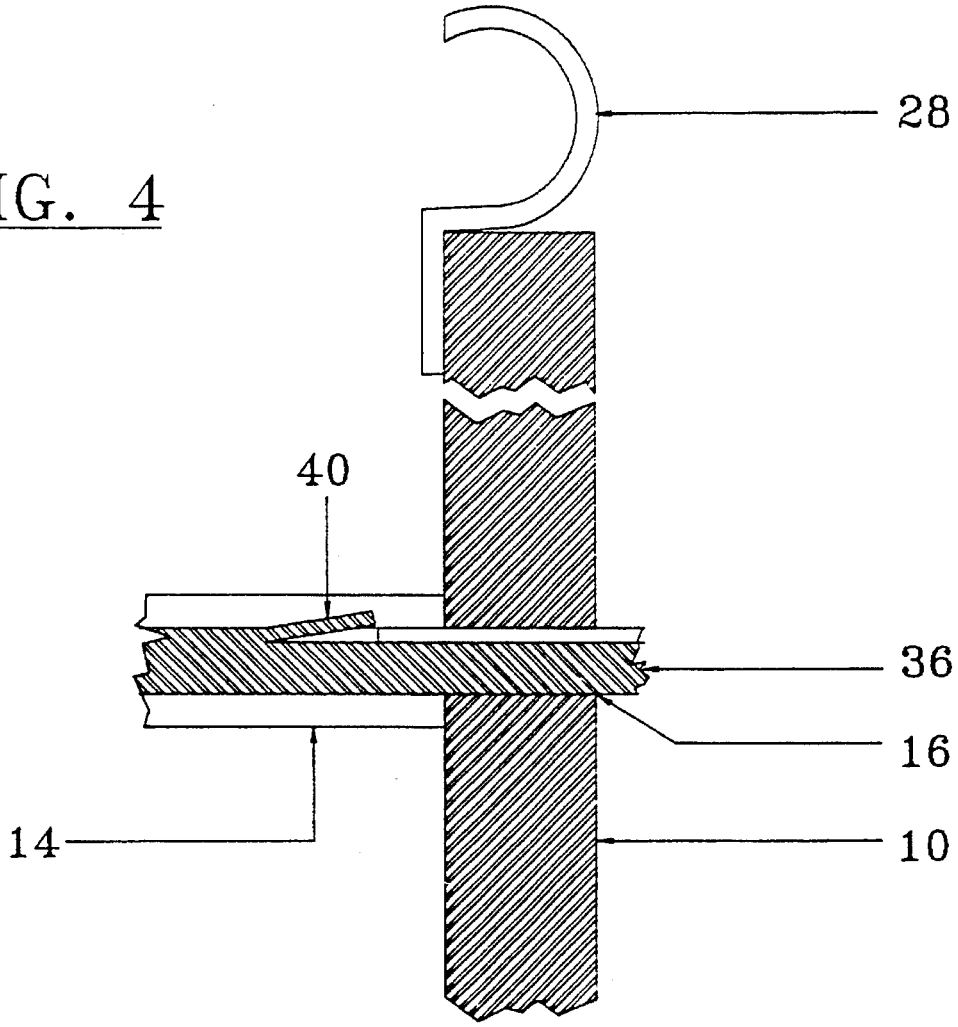
FIG. 4 is a cross-sectional view of the accessory taken along line 4—4 FIG. 2.

Referring to FIGS. 1–7, an accessory is shown having a first frame, comprising a first support 10 and primary braces 12 and 14. First support 10 may be a molded plastic panel that is 9 inches (22.9 cm) wide and with a height that varies from 2 to 2 ¾ inches (5 to 7 cm). It will be appreciated that the panel can be made of other materials and can be sized differently in other embodiments. Slot 16 is shown parallel to the bottom edge of support 10.

Figure 5:
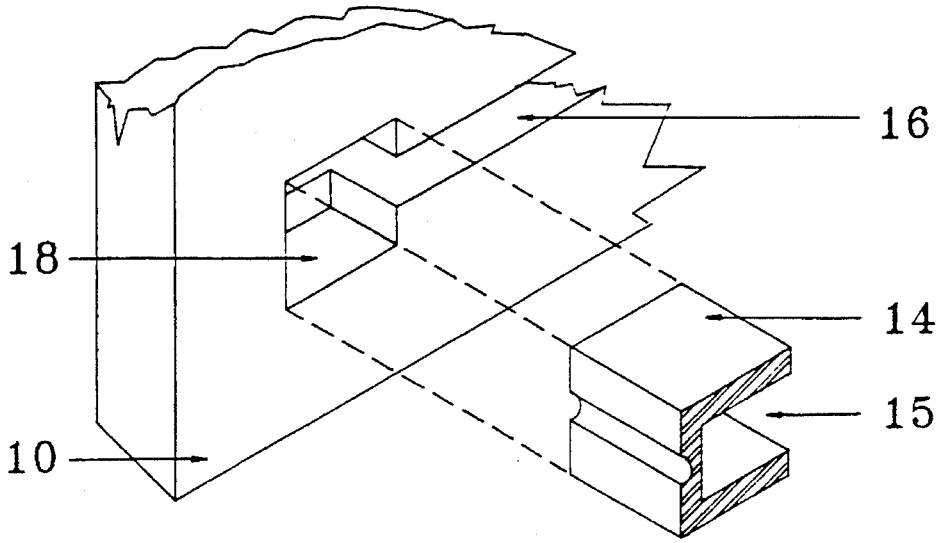
FIG. 5 is detailed, exploded view of the joint at the lower left corner of FIG. 2 between the support and channel.

Braces 12 and 14 are shown as channels having C-shaped cross-sections. A brace having other than a C-shape may be considered a channel. For example, an H-shaped brace or other brace having a longitudinal concavity or track may be considered a channel. FIG. 5 shows the outside end of channel 14 fitting into a mortise 18 that communicates with slot 16. Channels 12 and 14 are secured to support 10 by gluing, heat sealing, or by other fastening means. The height of the opening 15 of channel 14 matches the height of the opening of slot 16. Accordingly, tray 16 can slide through slot 16 and into openings 13 and 15 of channels 12 and 14. Channels 12 and 14 are ¾ inch (1.9 cm) tall and ½ inch (1.3 cm) wide. The openings 13 and 15 are about ¼ inch (0.6 cm)

tall. In other embodiments these dimensions can differ significantly.

Grippers in the form of hooks 26 and 28 are shown mounted at the top edge of support 10. Because the height of support 10 varies from end to end, the elevation of hooks 26 and 28 vary likewise. Hooks 26 and 28 may be metal stampings having a cylindrical upper end and planar lower end. The hooks 26 and 28 may be attached by gluing, riveting or by other fastening means.

A second frame is shown with a second support 20. Again, support 20 can be a molded plastic panel 9 with a length and height similar to support 10. The top edges of supports 10 and 20 are tilted in the same direction. Again, grippers, shown as hooks 30 and 32, are mounted to the top edge of support 20. Hooks 30 and 32 are fabricated and attached in the same way as previously mentioned hooks 26 and 28.

The lower corners on the inside face of support 20 are mortised to receive the outside ends of secondary braces, shown as channels 22 and 24. Channels 22 and 24 are 1 inch (2.5 cm) tall and ¾ inch (1.9 cm) wide, although these dimensions can vary in other embodiments.

Channel 14 is shown slidably mounted inside channel 24. Similarly, channel 12 is slidably mounted inside channel 22. The spacing between channels 22 and 24 is fixed by strut 34, which is mounted atop the inside ends of those channels. In a similar fashion strut 35 is mounted in channels 12 and 14 at their inside ends. Struts 34 and 35 may be secured by gluing, nailing or other fastening means, as well as by being integrally molded.

Tray 36 is slidably mounted through slot 16 and into the openings 13 and 15 of channels 12 and 14. Tray 36 may be of various sizes but is shown here about 16 inches (40.6) long, 8 inches (20.3 cm) wide, and ¼ inch (0.6 cm) thick. Tray 36 has a cup holder in the form of a hole 38 sized to receive a beverage glass, coffee container, or similar article. In some embodiments hole 38 may be replaced with a recess or an annular ridge designed to hold a cup without the need for an opening in the tray.

Tray 36 has a cantilever tab 40 pointing upwardly and toward support 10. Tab 40 is much like a section of material that has been peeled from the surface of tray 36. Tab 40 acts as a flexible locking device. Thus when tray 36 is passing through slot 16, tab 40 is depressed, but will spring back to the illustrated position when emerged from the slot. Once through slot 16, tab 40 prevents tray 36 from being pulled out again through slot 16. In some embodiments several reinforcing ribs (not shown) underlie and run the length of tray 36. In that case slot 16 will have matching slots to accommodate passage of the ribs.

The minimum spacing between supports 10 and 20 is about 16 inches (40.6 cm) when channels 12 and 14 are fully retracted into channels 22 and 24. The supports 10 and 20 can be pulled apart to expand this support to support spacing by about 7 inches (17.8 cm), although in some embodiments the range of expansion can be different.

Figure 6:
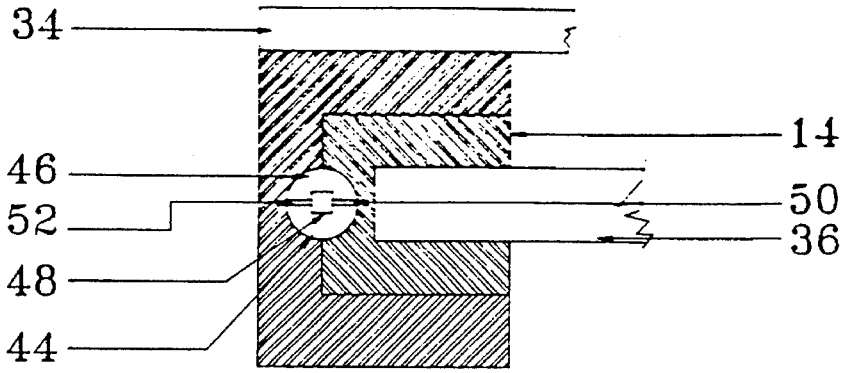
FIG. 6 is a detailed, sectional view of the channels, tray and strut, taken along line 6—6 of FIG. 1.
Figure 7:
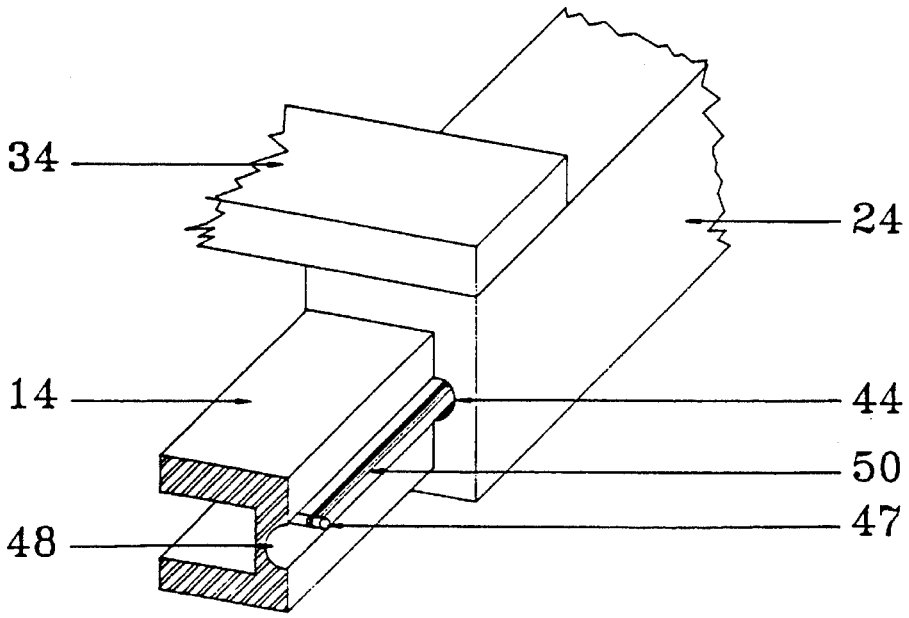
FIG. 7 is a detailed axonometric view of the joint between the channels in the accessory of FIG. 1.

Referring to FIGS. 6 and 7, previously illustrated channels 14 and 24 are shown telescopically interconnected. The outside vertical face of channel 14 is shown with a longitudinal, semicylindrical track 42. The inside vertical face of channel 24 is shown with a longitudinal, semicylindrical track 44. Tracks 42 and 44 together form a slender cylindrical cavity between channels 14 and 24 (although the tracks may be rectangular or shaped otherwise).

A yielding means is shown mounted inside cavity 46. Specifically, an elastic band 48 is stretched between pin 50 mounted in track 42 of channel 14 and pin 52 mounted in track 44 of channel 24. Consequently, elastic band 48 can draw channels 14 and 24 together to reduce the support to support spacing. A similarly set of tracks and elastic band is mounted in a cylindrical cavity between channels 12 and 22. In other embodiments, band 48 can be replaced with a spring. Alternatively, a spring may be connected directly between supports 10 and 20 or elsewhere.

In some embodiments channel 14 can be reversed with its opening facing the opening of channel 24. In this case the openings of both channels provide ample clearance for the retracting band 48 (or a retracting spring). Tray 36 can then be slidably mounted in a groove formed between two parallel ridges formed on the inside face of modified channel 14.

Figure 8:
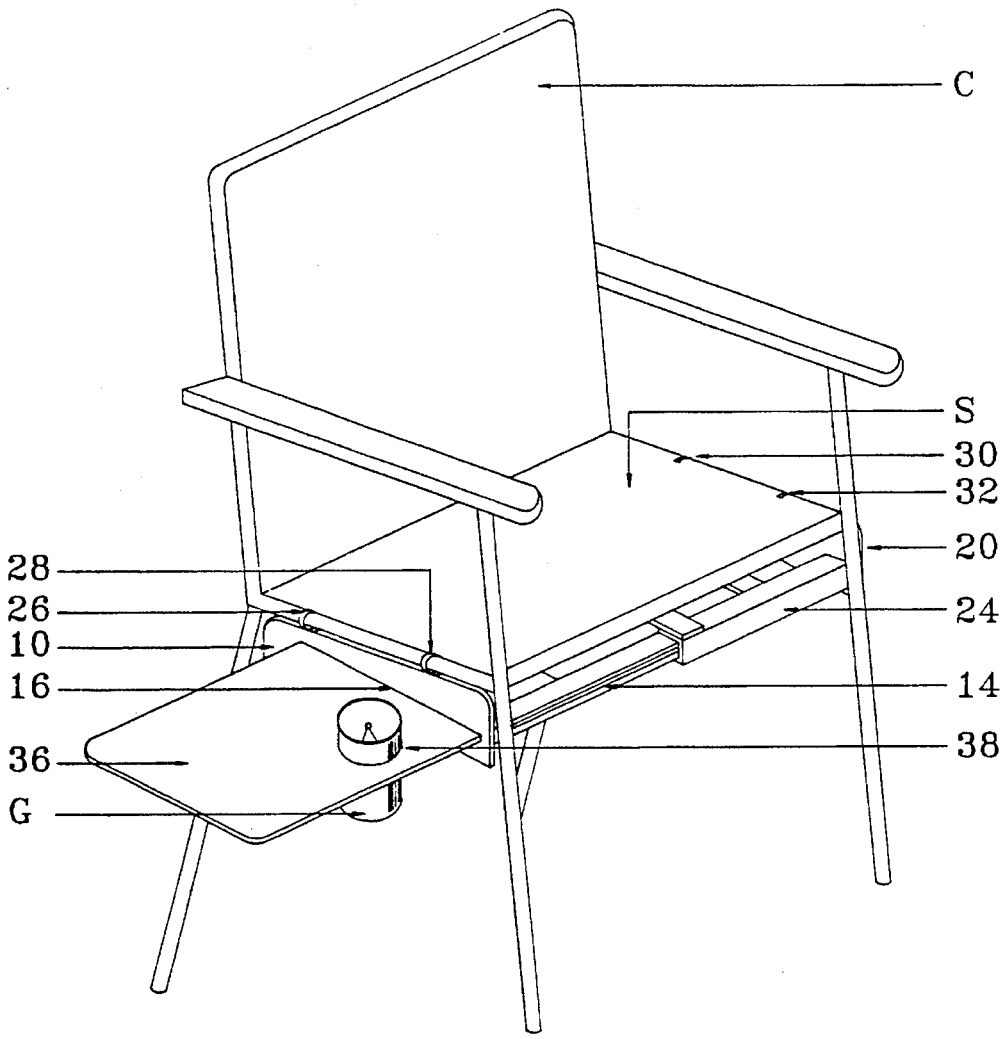
FIG. 8 is an axonometric view showing the accessory of FIG. 1 attached to the seat of a chair.

To facilitate an understanding of the principles associated with the foregoing apparatus, its operation will now be briefly described, in connection with FIG. 8 and the other Figures. The accessory of FIG. 1 can be grasped at supports 10 and 20 and pulled apart, to increase the spacing between the hooks 26, 28 and hooks 30, 32. With the hooks sufficiently separated, the accessory can be positioned underneath the seat S of chair C. The hooks are positioned at the right and left edges of seat S and then the supports 10 and 20 are released.

The tension in bands 48 (FIGS. 6 and 7) partially collapses channels 14 and 24, as well as channels 12 and 22. Consequently, supports 10 and 20 are drawn together so that hooks 26 and 28 are clamped securely to one edge of seat S while hooks 30 and 32 are clamped securely to the opposite edge.

If tray 36 is in the fully extended position shown in FIG. 8, the tray can hold dishes of food. Also, a glass or cup G can be inserted into cup holder 38. Because the upper edges of supports 10 and 20 are canted, the chair seat S may be tilted but the tray 36 will remain horizontal.

If tray 36 is not needed and glass G is removed, tray 36 can be pushed inwardly. Consequently, tray 36 slides through slot 16 and through the openings 13 and 15 of channels 12 and 14. Tray 36 cannot be pulled completely pulled out of support 10, however, because cantilever tab 40 hits the inside face of support 10 to prevent full removal (without special manipulation).

It is to be appreciated that various modifications may be implemented with respect to the above described, preferred embodiments. For example, the illustrated supports may be integral with the channels. In some embodiments, the channels will be bent to have a U-shaped longitudinal axis, with the hooks mounted directly onto the transverse length of the channel. Moreover, spring loaded gripping jaws may be used instead of hooks. Alternatively, the illustrated hooks may be replaced with gripping grooves formed directly on the supports. Also, in some embodiments the channels may be replaced with two boards that are held together with appropriate fasteners and slots to allow longitudinal expansion. Furthermore, in some embodiments the elastic band may be eliminated and the width of the accessory held by set screws or other clamping devices. While the illustrated embodiment employs primarily molded plastic parts, in other embodiments, metals, ceramics, wood or other materials may be used instead. Furthermore, the various dimensions may be altered depending upon the size of the intended chair or the desired size of the tray.

Obviously, certain modifications and variations of the present invention are possible in light of the above teachings. It is therefore to be understood that within the scope of the appended claims, the invention may be practiced otherwise than as specifically described.

I claim:

1. An accessory for a seat of a chair comprising:

an assembly having a pair of opposite grippers and arranged for attachment underneath the seat of said chair, said assembly including tray support means;

a tray slidably mounted by said tray support means for retracting underneath and extending beyond the seat of said chair;

first and second frames telescopically connected together, said first frame defining said tray support means; and wherein each of said first and second frames include one of said pair of opposite grippers; and biasing means coupled to said first and second frames and arranged and constructed for urging said first and second frames and said opposite grippers together.

2. An accessory according to claim 1 wherein tray has a first edge and a second edge parallel to said first edge; wherein said first frame comprises a spaced pair of primary braces and a first support, said primary braces extending from said first support, being disposed in parallel and each having a channel for receiving a respective edge of said tray; and wherein said second frame comprises a second support and a pair of secondary braces extending away in parallel from said second support and having a channel for slidingly receiving a respective primary brace.

3. An accessory according to claim 2 wherein said grippers are separately supported on said first and second supports.

4. An accessory according to claim 3 wherein each of said grippers comprise a pair of hooks.

5. An accessory according to claim 4 wherein said hooks are positioned to keep said tray level notwithstanding a tilt in the seat.

6. An accessory according to claim 2 wherein said first support has a slot sized to receive said tray.

7. An accessory according to claim 6 wherein said tray has between said first and second supports a cantilevered tab pointing toward said first support to prevent said tray from being pulled out of said first support.

8. An accessory according to claim 7 wherein said tray further includes means for holding a cup.

9. An accessory according to claim 8 comprising:

a strut attached between said secondary braces.

10. An accessory according to claim 9 wherein said biasing means is mounted between at least one of said primary braces and an adjacent one of said secondary braces.

11. An accessory according to claim 9 wherein said primary braces each have an outer longitudinal track, said secondary braces each having an inner longitudinal track, said biasing means comprising a pair of resilient members each separately mounted between the track of a corresponding one of said primary braces and the track of an adjacent one of said secondary braces.

12. The accessory of claim 1, further including means for positioning said tray at an angle with respect to said seat for maintaining said tray substantially horizontal.

13. An accessory for a chair of the kind having a seat defined by two opposed seat support members, said accessory comprising:

a flat tray formed of a planar surface having two parallel tray edges;

a first frame defined by a first frame support with an opening for receiving said tray, and two first frame braces attached to and extending in parallel from said first frame support, said braces having facing channels for slidably receiving said tray edges;

a second frame defined by a second frame support, and two frame braces attached to and extending in parallel from said second frame support, said second frame braces having channel means for telescopically coupling with said first frame braces; means for securing said first and second frame supports to said seat support member;

resilient biasing means coupled to said frames for biasing said frames and the securing means toward each other;

said first and second frames being slidable along said support members to accommodate size variations of said seat.

14. The accessory of claim 13 wherein each of said first support braces has a distal end spaced away from said first frame support member, said first frame further comprising a strut attached to said distal ends.

15. The accessory of claim 13 wherein said second frame braces have facing second frame brace channels for slidably receiving said first frame braces.

16. The accessory of claim 15 wherein said first frame braces have outer surfaces and said biasing means extend from one of said outer surfaces and one of said second frame braces.

17. The accessory of claim 13 wherein said flat tray is formed with stop means constructed and arranged to limit the movement of said tray and prevent said tray from being pulled out of said first frame.

18. An accessory for attachment underneath a seat of a chair, comprising:

a tray having a cup holder;

a first support having a slot sized to receive said tray, said tray being mounted in said slot and having to the inside of said first support a cantilevered tab pointing toward said first support to resist said tray being pulled out of said first support;

a first pair of hooks supported on said first support;

a spaced, parallel pair of primary channels attached to said first support, said tray being slidably mounted in and embraced by said primary channels for retracting underneath and extending beyond the seat of said chair, said primary channels each forming an outer longitudinal track;

a second support;

a second pair of hooks supported on said second support, said first and said second pairs of hooks being positioned to keep said tray level notwithstanding a tilt in the seat;

a spaced, parallel pair of secondary channels attached to said second support, each of said secondary channels being slidably mounted on a different, corresponding one of said primary channels, the secondary channels each embracing a corresponding one of said primary channels, said secondary channels each forming an inner longitudinal track;

a strut attached between said secondary channels; and a pair of resilient members each separately mounted between the track of a corresponding one of said primary channels and the track of an adjacent one of said secondary channels.

* * * * *